US008650662B2

(12) United States Patent
Decker

(10) Patent No.: US 8,650,662 B2
(45) Date of Patent: Feb. 18, 2014

(54) METHOD AND APPARATUS FOR PROVIDING SLEEVES TO AN OTHERWISE SLEEVELESS GARMENT

(76) Inventor: Kelley Decker, Chicago, IL (US)

( * ) Notice: Subject to any disclaimer, the term of this patent is extended or adjusted under 35 U.S.C. 154(b) by 34 days.

(21) Appl. No.: 13/355,881

(22) Filed: Jan. 23, 2012

(65) Prior Publication Data

US 2013/0185845 A1 Jul. 25, 2013

(51) Int. Cl.
*A41C 3/08* (2006.01)
*A41D 3/00* (2006.01)

(52) U.S. Cl.
USPC ..... 2/16; 2/59; 450/31

(58) Field of Classification Search
USPC ..... 2/16, 59, 125, 126, 310, 311
See application file for complete search history.

(56) References Cited

U.S. PATENT DOCUMENTS

| | | | | | |
|---|---|---|---|---|---|
| 361,250 | A | * | 4/1887 | Wright | 2/85 |
| 1,157,341 | A | * | 10/1915 | Tallerday | 2/91 |
| 1,250,836 | A | * | 12/1917 | Fowler | 2/91 |
| 1,285,917 | A | * | 11/1918 | Bradlet | 2/91 |
| 2,603,789 | A | * | 7/1952 | Straus | 2/108 |
| 2,675,556 | A | * | 4/1954 | Collier | 2/108 |
| 3,160,892 | A | * | 12/1964 | Semons | 2/88 |
| 4,016,027 | A | * | 4/1977 | Kintanar | 2/159 |
| 4,554,682 | A | * | 11/1985 | Hillquist | 2/70 |
| 4,559,647 | A | * | 12/1985 | Smith et al. | 2/158 |
| 4,569,089 | A | * | 2/1986 | Nesse | 2/108 |
| 4,570,267 | A | * | 2/1986 | Appel | 2/91 |
| 4,625,338 | A | * | 12/1986 | Starling | 2/106 |
| 4,706,304 | A | * | 11/1987 | Jones | 2/91 |
| 4,764,988 | A | * | 8/1988 | Reaver | 2/268 |
| 5,088,116 | A | * | 2/1992 | Gould | 2/82 |
| 5,357,633 | A | * | 10/1994 | Rael | 2/16 |
| 5,504,944 | A | * | 4/1996 | Bromer et al. | 2/269 |
| 5,718,000 | A | * | 2/1998 | Ost et al. | 2/69 |
| 6,000,993 | A | * | 12/1999 | Erwin | 450/7 |
| D431,343 | S | * | 10/2000 | Sampson | D2/610 |
| 6,146,239 | A | * | 11/2000 | Magliocchetti | 450/1 |
| 6,183,339 | B1 | * | 2/2001 | Thompson | 450/1 |
| D442,765 | S | * | 5/2001 | Newman | D2/610 |
| 6,298,485 | B1 | * | 10/2001 | Heller | 2/70 |
| 6,393,611 | B1 | * | 5/2002 | Thompson | 2/55 |
| 6,996,847 | B2 | * | 2/2006 | Anderson et al. | 2/16 |
| 7,028,342 | B1 | * | 4/2006 | Nordstrom et al. | 2/119 |

(Continued)

OTHER PUBLICATIONS

Mary Portas—Chamos Armory Sleeves—Sep. 2011 Found on www.uktights.com.

(Continued)

*Primary Examiner* — Bobby Muromoto, Jr.
(74) *Attorney, Agent, or Firm* — Clifford Kraft

(57) ABSTRACT

A method and apparatus for supplying a variety of stylish sleeves for wear with sleeveless outfits. A bust band circles the rib cage and the back with either front or back closure. A pair of shoulder straps are attached to the bust band. Stylish lace, sheer or other sleeves are sewed or otherwise attached to the shoulder straps and/or bust band. The band generally runs around the front chest just under the bra and around the back at the approximate vertical location of the rear part of the bra. The sleeves are typically sewed onto the shoulder straps and/or bust band; however, it is within the scope of the present invention to use removable sleeves with various fastening techniques. In the preferred embodiment, small silicone strips are attached to the interior of the shoulder straps that allow the sleeves to adhere to the shoulder and not slip down.

12 Claims, 6 Drawing Sheets

(56) References Cited

U.S. PATENT DOCUMENTS

| | | | | |
|---|---|---|---|---|
| 7,066,784 | B2 * | 6/2006 | Peay | 450/31 |
| 7,343,629 | B2 * | 3/2008 | Hunt | 2/93 |
| D572,435 | S * | 7/2008 | Bily et al. | D2/828 |
| 7,429,206 | B2 * | 9/2008 | Perry | 450/86 |
| D578,278 | S * | 10/2008 | Song | D2/823 |
| D618,885 | S * | 7/2010 | Ballsieper et al. | D2/828 |
| D639,527 | S * | 6/2011 | Stoffle | D2/717 |
| D646,869 | S * | 10/2011 | Greenblat | D2/750 |
| 8,082,597 | B2 * | 12/2011 | Young | 2/119 |
| D675,811 | S * | 2/2013 | Stevens | D2/847 |
| 2002/0002023 | A1 * | 1/2002 | Nakanishi | 450/66 |
| 2004/0199976 | A1 * | 10/2004 | Hunt | 2/93 |
| 2009/0047481 | A1 * | 2/2009 | Welsch et al. | 428/179 |
| 2010/0199403 | A1 * | 8/2010 | Greenblat | 2/69 |
| 2012/0079644 | A1 * | 4/2012 | Benderradji | 2/207 |

OTHER PUBLICATIONS

Kymaro Shrug Shapper—Date unknown—prior to applicant's filing date—Found on www.ubuyez.com.

Charmz—Date unknown—Copyright 2012—prior to applicant's filing date—Found on www.ch-armz.com.

Tres Sleek—Copyright 2010—Found on www.tressleek.com.

The Have Nots—Copyright 2010—Found on www.slimpressions.com.

* cited by examiner

METHOD AND APPARATUS FOR PROVIDING SLEEVES TO AN OTHERWISE SLEEVELESS GARMENT

BACKGROUND

1. Field of the Invention

The present invention relates generally to garments for women and more particularly to a method and apparatus that supplies unattached sleeves.

2. Description of the Problem

Dresses, evening gowns and tops are often times sleeveless. While these sleeveless garments continue to be in style, not all women want to partially or totally expose their arms. Nevertheless, they would still like to be able to wear these garments without limitation. Other women would like to make a stylish statement by adding a decorative sleeve to their existing look. Wearing a sleeved blouse or shirt under sleeveless garments adds weight, bunches and will not lie flat adding visible lines and creases. It also restricts the exposure of both the neckline and the upper back, distracting from the intended design of the garment. Additionally, there are added difficulties in matching up the sleeved blouse or shirt shoulder seams and armholes with the sleeveless garment, making it nearly impossible to achieve the look intended. Also, often times women who are looking to conceal their arms are of either a certain age or a certain weight, and may feel too warm layering two fully constructed independent garments. This, along with the obstruction of the desired worn garment, is one of the reasons why the wearer of the sleeveless garment would not wish to wear a jacket or sweater/cardigan on top of the sleeveless piece.

It would be tremendously advantageous to have a garment made to be worn with sleeveless outfits that supplies stylish sleeves which enhance the look of the outfit, and yet provide a coverage for the arms. Different versions of the garment could be made using different types of fabric so that by changing this garment, many different sleeve combinations could be realized time and time again.

SUMMARY OF THE INVENTION

The present invention relates to a garment that supplies a variety of stylish sleeves for wear with sleeveless outfits. A bust band circles the rib cage and the back with either front or back closure. A pair of shoulder straps are attached to the bust band, one on either side. Stylish lace, sheer or any other fabric sleeves are sewed or otherwise attached to the shoulder straps and/or bust band, encapsulating the otherwise exposed underarm. The band generally runs around the front chest just under the bra and around the back at the approximate vertical location of the rear part of the bra. It is within the scope of the present invention to use removable sleeves with various fastening techniques to attach the sleeves to the shoulder straps and bust band. In the preferred embodiment, small silicone strips can be attached to the interior of the shoulder straps allowing the sleeves to adhere to the shoulder and not slip down, the absence of which would require additional strap support either across the back or chest, obstructing both neckline and back exposure.

DESCRIPTION OF THE FIGURES

Attention is now directed to several drawings that illustrate features of the present invention.

Several drawings and illustrations have been presented to aid in understanding the present invention. The scope of the present invention is not limited to what is shown in the figures.

DESCRIPTION OF THE PREFERRED EMBODIMENT

The present invention relates to a method and apparatus for supplying lace (or any other type) of sleeves that women can wear with sleeveless outfits to avoid total exposure of the arms and underarms while allowing full exposure of the wearers neckline and upper back and/or to present a stylish look.

Figure 1:
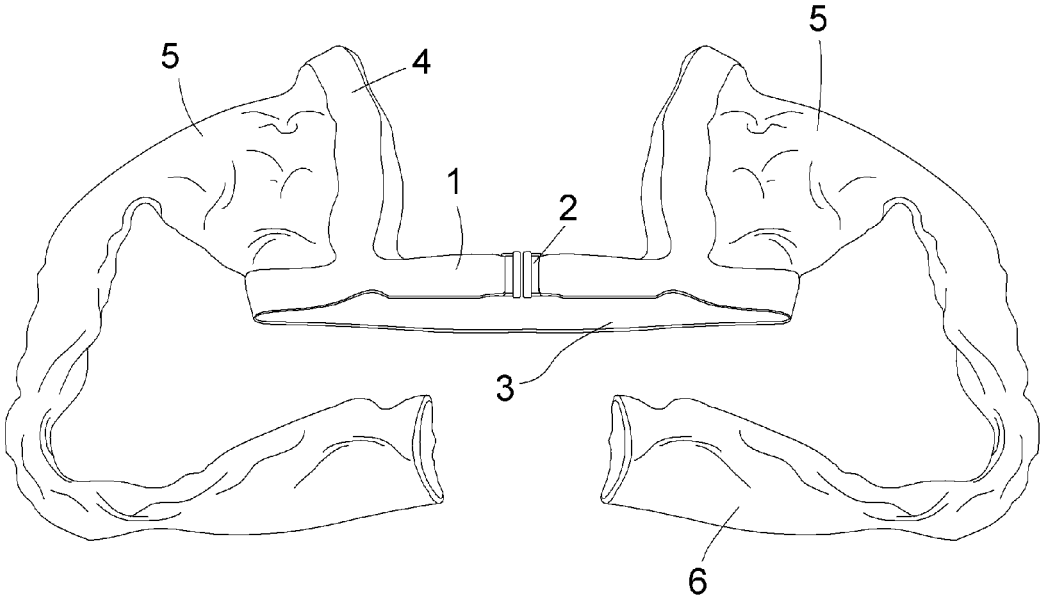
FIG. 1 is a drawing of an embodiment of the present invention.

Turning to FIG. 1, embodiments of the present invention include a bust band 1 that can be front 2 or rear closed (rear-closed not shown). This base band has a rear portion 3 that circles around the back of the wearer at about the level of the rear of a bra. The front band 1 typically runs just under the lower bra line. A pair of shoulder straps 4 pass over the shoulders holding the device in place vertically. A sleeve with an upper part 5 is sewed onto the outer part of each shoulder strap 4. The rest of the sleeve 6 usually extends to about the wrist. While extending to the wrist is the preferred length for the sleeves 6, the present invention includes any length sleeve from short sleeves to very long sleeves. The sleeves 5, 6 can be made of any stylish material; however, it is preferred they are a lace or sheer fabrication to allow the appearance to subtly match the outfit and make a very stylish statement.

Figure 2B:
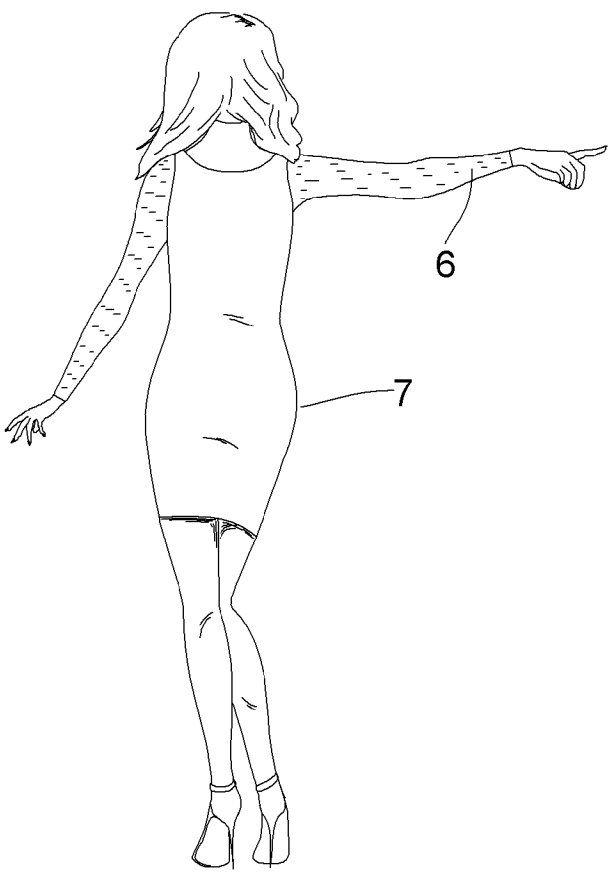
FIG. 2B is a back view of the model from FIG. 2A.
Figure 2A:
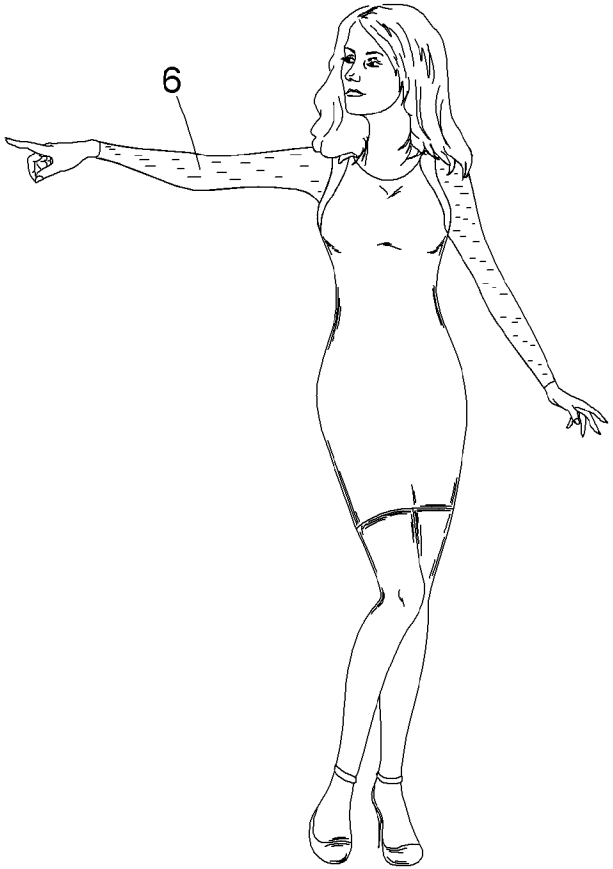
FIG. 2A shows a front view of a model wearing an embodiment of the present invention.
Figure 3B:
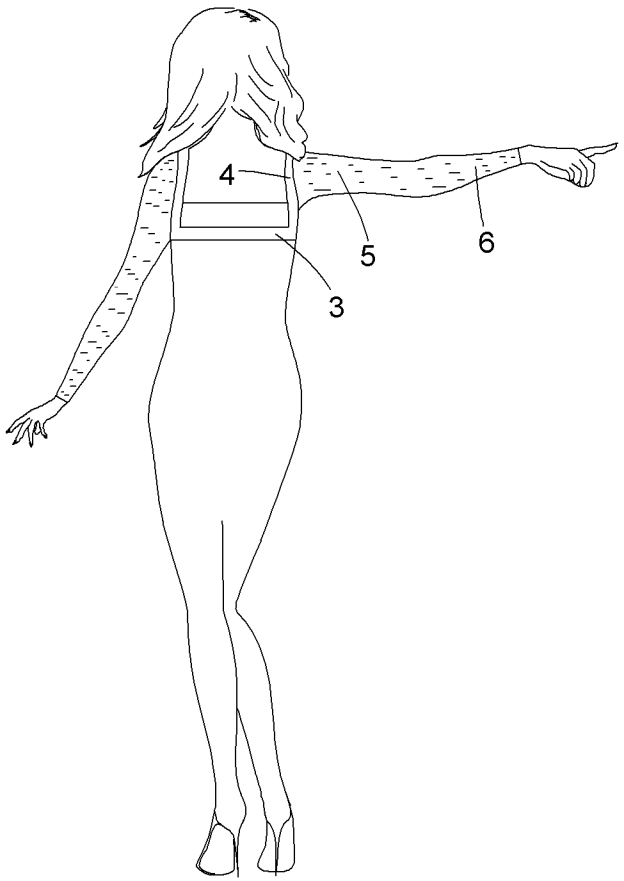
FIG. 3B is a back view of the model from FIG. 3A.
Figure 3A:
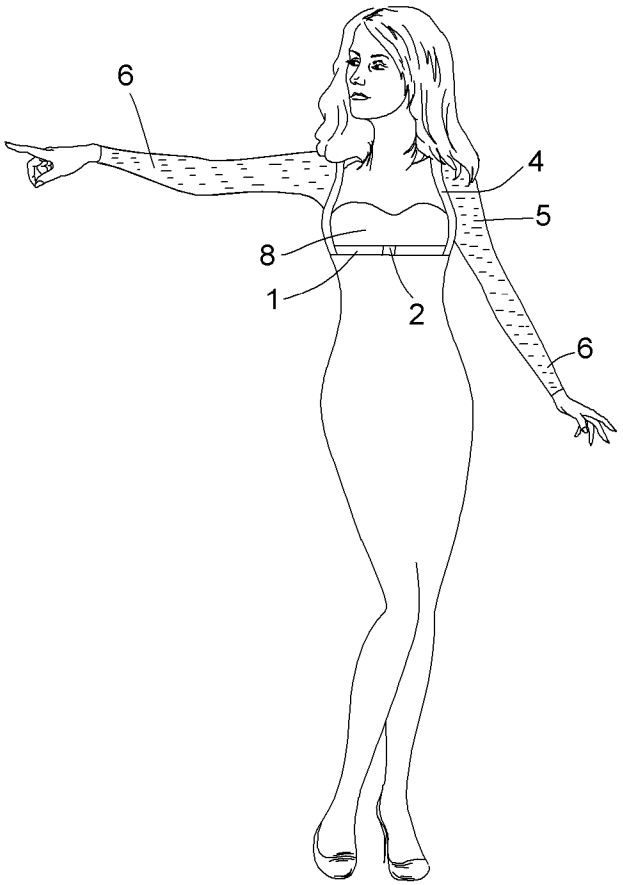
FIG. 3A is a front view similar to FIG. 2A showing only the invention.

FIGS. 2A-2B show a model wearing an embodiment of the invention. The model is wearing a sleeveless dress 7 with the sleeves 6 of the present invention extending along her arms. FIG. 2B is a back view of the model from FIG. 2A. FIGS. 3A-3B show the same model; however, the dress has been removed for clarity of how the present invention is worn. Here, the model wears a bra 8. The front band 1 of the invention typically passes just below the lower front of the bra 8. The closure 2, if in the front, can be directly below the center of the bra 8. The shoulder straps 4 are typically located where bra straps would be on a strapped-bra (in many cases, a strapless bra can be worn with the present invention). The upper 5 and lower 6 parts of the sleeves can be seen extending to the wrist. FIG. 3B shows the back of the model with the vertical position of the back band 3 clearly shown.

Figure 4:
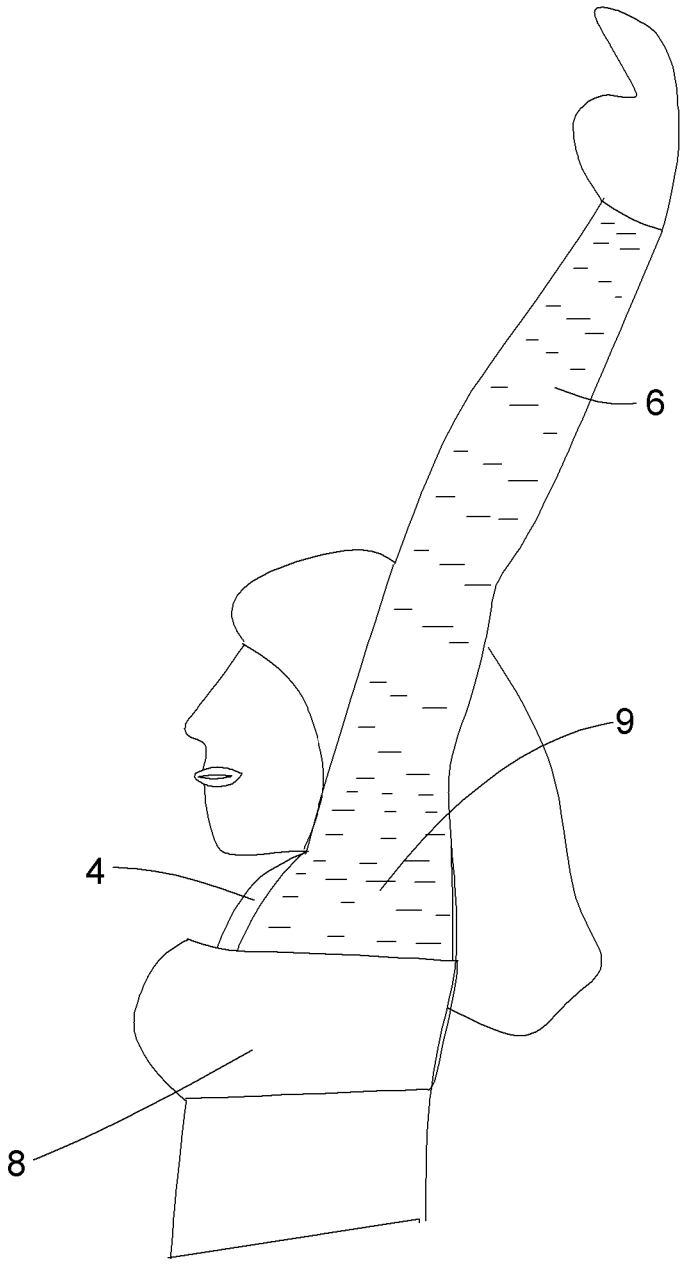
FIG. 4 is a side view of a model wearing an embodiment of the invention.

FIG. 4 shows a side view of the model from FIGS. 2-3 with her arms extended upward showing the underarm area 9. It is important that the material encapsulating the underarm area not be bulky or folded to where it digs into the underarm. Again, the relative locations of the bra 8, the shoulder straps 4 and the lower sleeves 6 can be seen.

The preferred embodiment of the product is built using three separate sewed pieces, two sleeves and a bust band. The bust band 1,3 is best made of stretchy material. It circles the rib cage and back, with either a front or back closure 2. The two straps 4 are attached to the band, one on each side. Both straps 4 are then attached to the sleeves 5, 6. This allows the wearer to easily put on and take off the garment, while also allowing the underarms 9 to be enclosed. The sleeves 5, 6, in the preferred embodiment, contour to the body.

Figure 5:
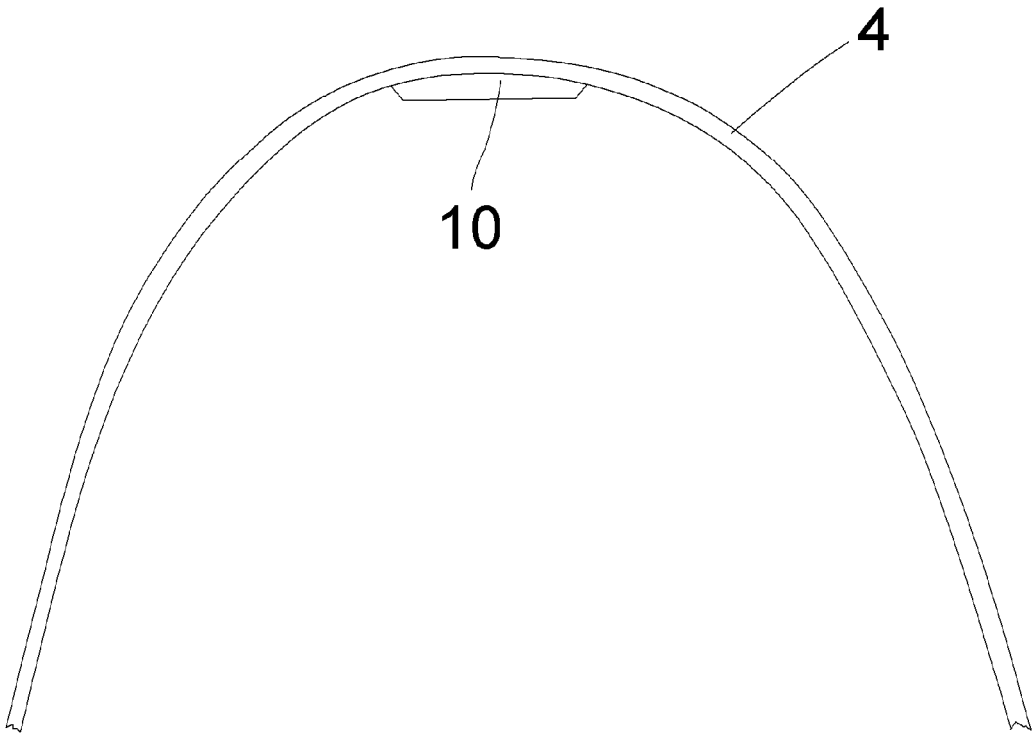
FIG. 5 is a detail view of a shoulder strap with silicone strip to prevent slipping.

To keep the straps 4 from slipping off of the shoulders, a small strip of silicone 10, as shown in FIG. 5, can be applied to the interior of the straps. This sticks to the skin without irritating and allows the upper sleeves to adhere to the shoulder which keeps them from slipping down. The use of a non-slip member such as silicone removes any requirement for a crisscross member between the straps.

In a preferred embodiment, the shoulder straps can be around 1 inch wide with a V-shape at the base for sewing to the bust band. These can be mitered to the bust band pieces and sewed with ⅛ inch braid. The edges of the bust band can be sewed with a smooth Marrow Stitch for appearance.

Figure 6A:
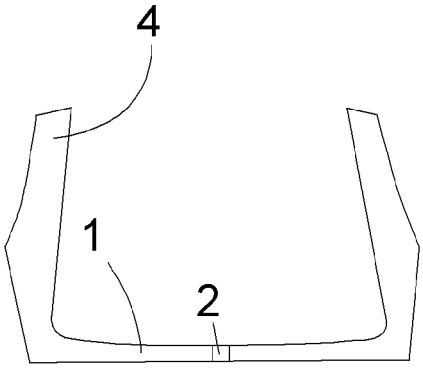
FIGS. 6A-6B show a detail of the front and back of the bust band.
Figure 6B:
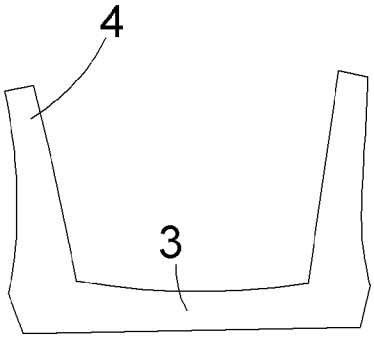

FIGS. 6A-6B show the a detail of the front and back of the bust band and shoulder straps without the sleeves.

As stated above, the preferred embodiment includes sleeves that are not generally removable; however, alternate embodiments allow removal of sleeves where the sleeves can be attached to the shoulder straps with one or more fasteners such as clips, buttons, lacing, or any other means of attachment. In the case of removable sleeves, the present invention can be used with many different sleeves that are made from different materials and have different styles.

Several drawings and illustrations have been presented to aid in understanding the present invention. One skilled in the art will recognize that numerous changes and variations may be made without departing from the spirit of the present invention. Each of these changes and variations is within the scope of the present invention.

I claim:

1. A method for providing sleeves for women's sleeveless garments comprising:

providing a stretchable bust band with front or rear closure that, when worn, passes below a bra in the front;

attaching a pair of shoulder straps to said bust band;

providing a plurality of matching sheer sleeve pairs, each sleeve contoured to fit a woman's arm;

removably attaching a single pair chosen from said plurality of matched sheer sleeve pairs to said shoulder straps;

providing a non-slip strip on a top interior surface of each of said shoulder straps;

allowing said sheer sleeve pair to be removed from said shoulder straps and substituted with a different pair from said plurality of matching sheer sleeve pairs.

2. The method of claim 1 wherein said sleeve pair extends to a wrist area.

3. The method of claim 1 wherein said non-slip strip is silicone.

4. The method of claim 1 wherein said sleeve pair extends to an elbow area.

5. The method of claim 1 wherein said bust band is stretch lace strap.

6. A device that provides sleeves for sleeveless garments comprising:

a generally circular bust band constructed from stretchable material adapted to circle a woman's chest just below a bra, said bust band having either a front or back closure;

a pair of shoulder straps attached to said bust band adapted to pass over a wearer's shoulders;

a pair of sheer sleeves chosen from a plurality of different sheer sleeve pairs removably attached to said shoulder straps, said sleeves contoured to a human arm;

a non-slip silicon strip mounted on a top interior surface of each of said shoulder straps.

7. The device of claim 6 wherein said sleeves extend to a wrist area.

8. The device of claim 6 wherein said sleeves extend to an elbow area.

9. The device of claim 6 wherein said bust band is stretch lace strap.

10. The device of claim 6 wherein said shoulder straps are approximately one inch wide.

11. A device that provides sleeves for sleeveless garments comprising:

a generally circular stretch lace strap bust band adapted to circle a woman's chest area below a bra, said bust band having either a front or back closure;

a pair of shoulder straps attached to said bust band adapted to pass over a wearer's shoulders;

a plurality of sheer sleeve pairs, wherein some of said plurality are wrist-length and others of said plurality are elbow length;

a pair of sheer sleeves chosen from said plurality removably attached to said shoulder straps and/or said bust band, said sleeves contoured to a human arm;

a silicone non-slip strip mounted on a top interior surface of each of said shoulder straps.

12. The device of claim 11 wherein said shoulder straps are approximately one inch wide.

* * * * *